United States Patent [19]

Shapiro

[11] Patent Number: 4,761,157

[45] Date of Patent: Aug. 2, 1988

[54] CENTRIFUGE APPARATUS

[75] Inventor: Leonard Shapiro, Doylestown, Pa.

[73] Assignee: Pennwalt Corporation, Philadelphia, Pa.

[21] Appl. No.: 495,841

[22] Filed: May 18, 1983

[51] Int. Cl.[4] ..... B04B 3/04

[52] U.S. Cl. ..... 494/35; 494/32; 210/96.1; 210/413

[58] Field of Search ..... 494/35, 32, 53; 210/96.1, 413, 414, 415

[56] References Cited

U.S. PATENT DOCUMENTS

| | | | |
|---|---|---|---|
| 1,710,316 | 4/1929 | Laughlin . | |
| 2,426,616 | 9/1947 | Jones | 494/35 X |
| 2,488,747 | 11/1949 | Strezynski . | |
| 2,500,100 | 3/1950 | Strezynski | 494/35 X |
| 2,532,792 | 12/1950 | Svensjo | 494/35 X |
| 2,614,748 | 10/1952 | Ritsch . | |
| 2,869,779 | 1/1959 | Geissler | 494/37 |
| 2,928,592 | 3/1960 | Johnson | 494/35 |
| 2,958,462 | 11/1960 | Wicklund | 494/35 X |
| 2,961,154 | 11/1960 | Bergey | 494/35 X |
| 3,011,647 | 12/1961 | Elsken | 494/35 X |
| 3,073,516 | 1/1963 | Glasson | 494/35 X |
| 3,200,068 | 8/1965 | Jonakin et al. . | |
| 3,245,613 | 4/1966 | Jonakin | 494/35 |
| 3,250,462 | 5/1966 | Thylefors | 494/35 X |
| 3,255,958 | 6/1966 | Simon | 494/35 X |
| 3,311,296 | 3/1967 | Torobin | 494/35 X |
| 3,407,999 | 10/1968 | Kirkpatrick | 494/35 X |
| 3,428,246 | 2/1969 | Finkelston . | |
| 3,570,754 | 3/1971 | Kirkpatrick | 494/35 X |
| 3,595,470 | 7/1971 | Penwalt | 494/35 X |
| 3,623,657 | 11/1971 | Trump | 494/35 X |
| 4,067,494 | 1/1978 | Willus et al. . | |
| 4,190,194 | 2/1980 | Amero . | |
| 4,278,200 | 7/1987 | Gunnewig | 494/35 X |
| 4,295,600 | 10/1981 | Saget . | |
| 4,339,072 | 7/1982 | Hiller . | |

FOREIGN PATENT DOCUMENTS

| | | | |
|---|---|---|---|
| 385629 | 10/1971 | U.S.S.R. | 494/35 |

*Primary Examiner*—Philip R. Coe
*Assistant Examiner*—Frankie L. Stinson

[57] ABSTRACT

A decanter centrifuge is equipped with a conventional screw conveyor which advances separated solids or heavy phase material toward a solids discharge zone, and it is also equipped with discharge nozzles mounted on the bowl wall for discharging concentrated solids therethrough from the solids discharge zone. In addition to light phase or liquid discharge means, the centrifuge is further provided with a recycle system which returns at least a portion of the discharged solids to the solids discharge zone via a conduit. At the end of the conduit are recycle tubes mounted on the hub of the screw conveyor. The effect of feeding recycled solids to the discharge zone, to which newly separated solids is also being advanced, is to increase the solids concentration of the solids being discharged by the discharge nozzles.

11 Claims, 2 Drawing Sheets

CENTRIFUGE APPARATUS

SUMMARY OF THE INVENTION

The present invention relates to centrifuge apparatus, especially to decanter centrifuges which have an elongated tubular bowl. The bowl defines a separation chamber, and there is a rotatable screw conveyor mounted in the bowl for moving separated solid material toward a discharge zone within the bowl at one end thereof. According to the invention, the concentration of discharged solids is increased by discharging wet solids from the bowl through discharge nozzles located at the discharge zone, by recycling the discharged solids to the discharge nozzles, and by advancing newly separated solids to the discharge zone for entry to the inlets of the same discharge nozzles by means of the screw conveyor.

BACKGROUND OF THE INVENTION

For a discussion of the difficulty of separating a mixture of liquid and a fine, heavy phase material, reference is made to U.S. Pat. No. 3,795,361, issued Mar. 5, 1974 in the name of C. Y. Lee to the assignee of the present application. The disclosure of the cited U.S. Pat. No. 3,795,361 is incorporated herein by reference for centrifuge construction details, although the present invention does not require a conical or disc shaped baffle. Essentially, the present invention seeks to separate large volumes of feed in an efficient manner, and to produce drier solids than has been accomplished heretofore with centrifuges of the type described.

If the advantages of the present invention are to be understood, it is essential to appreciate the distinctions between centrifuges of the type set forth and centrifuges having an internal disc stack, such as shown in U.S. Pat. No. 3,799,431. Although the last mentioned centrifuge has discharge nozzles and provision for recycle, it is a separate class of centrifuge which has no mechanical device for advancing solids to their discharge.

DESCRIPTION OF PRIOR ART

U.S. Pat. No. 4,339,072 to Hiller discloses nozzles in the bowl wall of a decanter centrifuge having a notched disc device seen in FIG. 2 which blocks the nozzles a portion of the time, thus providing a pulsating flow which has a lower flow rate than if the notched disc were removed. Further provided is a means for regulating the rate of flow through the nozzles by varying the speed of the conveyor. However, nozzle flow rate does not vary by varying the speed of the disc relative to the bowl. The Hiller construction totally lacks the concept of controlled recycle of solids discharge to control the concentration of separated solids.

U.S. Pat. No. 3,200,068 to Jonakin et al discloses a centrifuge cooperating with an external means for separating fines from effluent and then returning the concentrated fines to the centrifuges. According to the present disclosure, the effluent is not treated after discharge. Rather, at least a portion of the separated heavy phase is recycled and concentrated. In addition, Jonakin et al lacks a recycle passageway for delivering recycled solids to the inlet of a discharge nozzle, and it also lacks a discharge nozzle and any suggestion of a control for the recycle system.

U.S. Pat. No. 2,614,748 to Ritsch does not teach the present invention because it has separate outlets for light solids and heavy solids without a nozzle mounted on the bowl. In addition, Ritsch does not offer a solution to the problem of controlling the concentration of the discharged solids. In any event, there is no teaching of recycling discharged solids, as is called for in applicant's claims, nor can there be any controls for recycle as recited in the dependent claims of the instant application.

BRIEF STATEMENT OF THE INVENTION

The present invention is applicable to a decanter centrifuge which continuously separates a thin, watery mixture of solids and liquid into separate phases, the first of which is a clarified, watery liquid phase, and the second of which is a thick or pasty solids phase. For convenience, these phases or components may be called light phase or liquid phase and heavy phase or solids phase, respectively, although strictly speaking the solids contain liquid. Indeed, the present invention is directed to controlling the solids concentration of the solids phase so that it is further thickened to a viscous mass.

A decanter centrifuge which may be improved by the present invention has an elongated tubular bowl adapted to receive a mixture to be separated called feed. The bowl interior defines a separation chamber, and it is mounted for rotation at high speed by a motor and pulley system in order to effect separation by centrifugation. Once separated, the components are separately discharged from the bowl. The liquid phase is discharged by suitable means, preferably out one end of the bowl through ports equipped with adjustable plate dams. The solids phase is preferably discharged from a solids discharge zone at the other end of the bowl. A conventional screw conveyor, rotated by a drive system at a speed slightly different than that of the bowl, is coaxially positioned inside the bowl and serves to move the separated solids phase toward the solids discharge zone for discharge.

Unlike a conventional decanter centrifuge, however, the solids phase is discharged by a plurality of nozzles rather than an overflow lip or weir at a tapered end of the bowl. The present bowl is preferably not tapered, however the invention may be practiced with a bowl that is of cylindrical configuration, as shown, or one which is tapered at the solids discharge end. In the latter case, the solids phase is primarily discharged through the discharge nozzle and an auxilliary solids discharge outlet is provided at the extreme end portion of the tapered end in order to dispose of tramp solids.

The solids discharge nozzles are mounted on the bowl so that their inlets are in the solids discharge zone and their outlets are outside the bowl; furthermore when compared to the nozzles in disc type centrifuges which have passageways in the range of between 0.8 and 2.0 mm., their passageways are unusually large, i.e. 3.0 mm. and larger in diameter, in order to reduce the likelihood of pluggage.

According to the present invention, a recycle system is combined with the above-described discharge nozzles in order to control the concentration of the solids discharge. This recycle system includes at least a conduit for conducting previously discharged solids back to the solids discharge zone within the bowl at the inlet of the discharge nozzles. Preferably, the recycle conduit extends adjacent to a feed pipe for newly introduced feed. The feed may flow through the conveyor hub to the separation chamber, while the recycled solids pass through the hub via special feed tubes or passageways directly to the solids discharge zone, and more particularly to the inlets of the solids discharge nozzles. In this way, recycled solids avoid contact with, and mixing with, newly introduced feed, thereby avoiding a second separation step for the recycled solids.

It can be seen that, with a constant pressure pump or control valve, the recycle system tends to be self-regulating, since the recycle flow rate is reduced as viscosity increases, and with less recycled solids the viscosity of the discharged solids tends to decrease.

Ideally, the flow rate of the recycled solids may be varied by providing a recycle system having provision for flow control. With flow control, the discharged solids may be collected in a tank having the inlet of the conduit connected thereto, there being a pump in the conduit for promoting flow therethrough. Further provided in the conduit is a pressure responsive diverter valve which, upon detecting an increase in pressure in the conduit (corresponding to an increase in viscosity of the solids flowing therethrough,) will divert such solids to a receiver tank. With this arrangement, solids may be recycled until the desired viscosity is attained; and the desired viscosity may be set by selectively adjusting the pressure at which the diverter valve opens to the receiver tank.

The present invention is not limited to any particular control means or to any particular basis for determining viscosity, concentration, or density of the recycled material, in order to control the recycle flow rate.

DESCRIPTION OF THE PREFERRED EMBODIMENT

Figure 1:
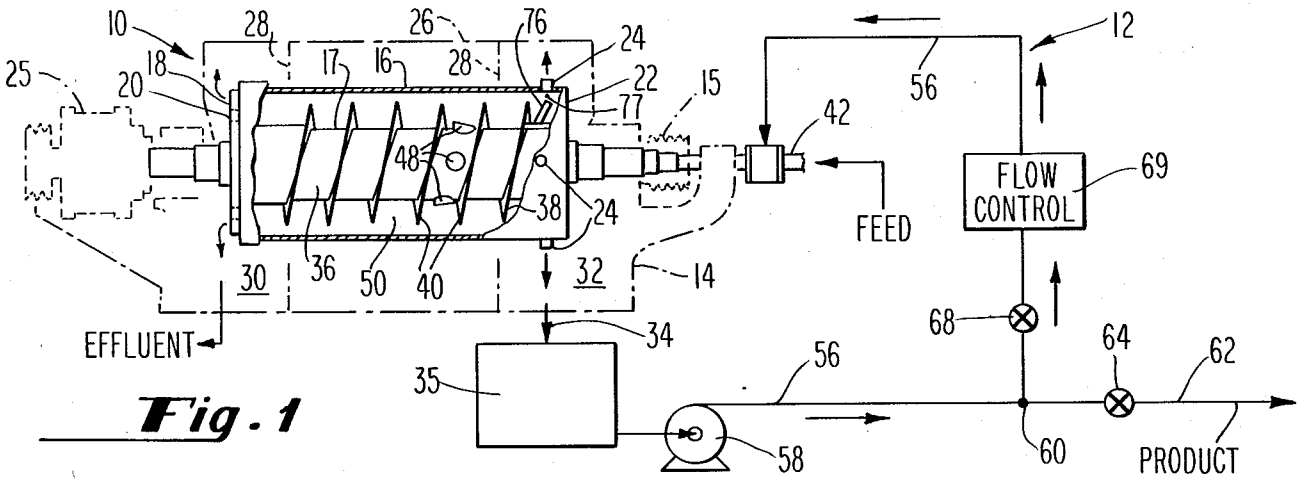
FIG. 1 is a view of a centrifuge according to the invention with its conveyor shown partly in elevation and partly in section, the outline of the centrifuge with its surrounding casing and supporting and driving parts shown in phantom, together with a schematic illustration of a recycle and discharge system for separated solids material.

As shown in the drawings, apparatus embodying the prepared embodiment of the invention comprises an improved centrifugal separator 10 and a controlled recycle system 12. Such apparatus is adapted for the continuous separation of a mixture of solids and liquid into separate light or liquid phase and heavy or solid phase components. The invention provides means for controlling the concentration of the heavy phase component. Certain details of the separator 10 and the system 12, which are well known to those skilled in the art, are omitted from the description and the illustration for the sake of brevity and clearness. Therefore, portions of the separator 10 illustrated in FIG. 1 are shown in phantom by broken lines and described briefly, while improved portions of the separator are shown and described in detail.

It is also to be understood that the present invention may be practiced in a centrifuge apparatus capable of separating three or more phases, e.g. a solids phase, a light liquid phase, and a heavy liquid phase, with the latter two phases being separately discharged at the same end of the bowl as is done with a single liquid phase in the present apparatus. Such an arrangement is described in U.S. Pat. No. 4,335,846, granted June 22, 1982 in the name of the present inventor,and, therefore details of such an arrangement are omitted from this disclosure.

The centrifugal separator 10 comprises a frame 14 supporting a driving pulley 15 and an elongated centrifuge bowl 16 of generally cylindrical shape for rotation on its longitudinal axis. Coaxially and helically disposed within the bowl 16 is a screw conveyor 17 which will be further described hereinafter. The bowl is mounted for rotation about its longitudinal axis. The bowl 16 is provided at one end 18 with a dam, as shown, or a port or other suitable means for discharging liquid phase material, e.g. effluent, and such means may be referred to herein as liquid discharge means and designated by the numeral 20 in the drawings.

Figure 3:
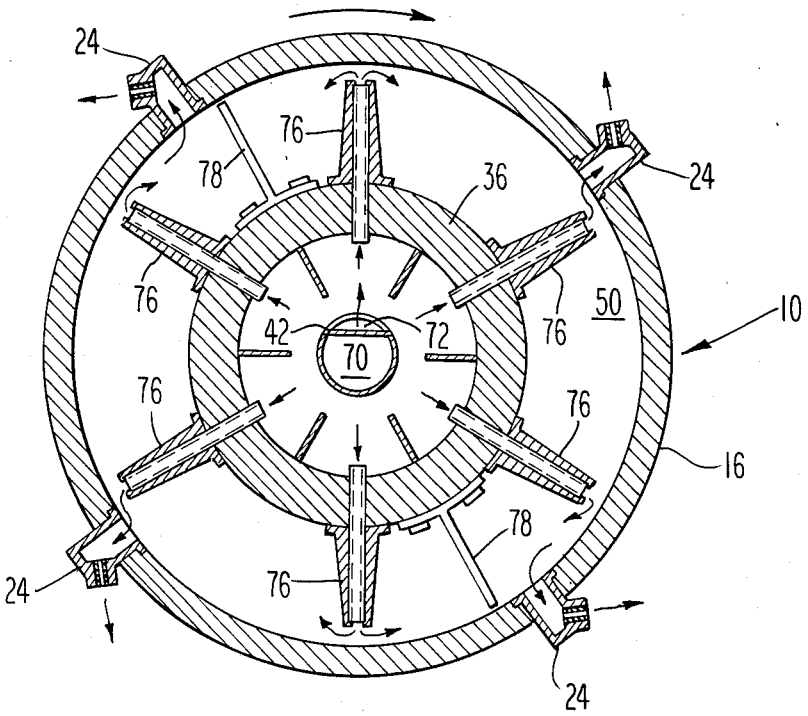
FIG. 3 a transverse sectional view of the centrifuge of FIG. 1, taken at the solids discharge end thereof.

At the other end 22 of the bowl 16 is the solids discharge means for discharging the separated heavy phase material which, in accordance with the present invention, comprises a plurality of discharge nozzles 24 in an annular array. Preferably two to four discharge nozzles 24 are provided, equally spaced about the outer circumference of the bowl 16, as compared with eight to sixteen nozzles which are used in a disc stack machine. For energy efficiency the nozzles 24 discharge in directions generally opposite to that of bowl rotation, as seen in FIG. 3. The nozzles 24 may be mounted in the end 22 of the bowl 16 if so desired.

When referring to separated heavy phase material or solids phase, the term "solids" is used herein with reference to flowable wet solids, e.g. wet solids which will discharge under pressure from a nozzle and which may be pumped through a conduit of suitable cross-sectional size and shape. A typical example is sewage sludge which is 4 to 9% solids (91 to 96% water) having the consistency of thick mayonnaise.

A casing 26 rests on the frame 14 and encloses the bowl 16. Partitions 28 within the casing 26 extend inwardly from the inner surface of the casing and terminate in closely spaced relationship with the exterior of the bowl 16, defining therewith a liquid discharge outlet 30 and a solids discharge outlet 32. Light phase material separated in the bowl 16 is discharged from the centrifugal separator 10 via the liquid discharge means 20 and the liquid discharge outlet 30, and separated heavy phase material is discharged from the bowl via the discharge nozzles 24, the solids discharge outlet 32, and a solids discharge conduit 34 leading from the outlet 32 to a receiver, i.e. a tank 35, as shown.

The screw conveyor 17 comprises an elongated hub 36 arranged coaxially within the bowl 16 and having mounted theron a helical blade 38, preferably in the manner set forth in the U.S. Pat. No. 3,812,564 of Leonard Shapiro. The blade 38 is composed of a plurality of flights 40, each representing a single turn in the helical form of the blade 38. If optional hard surfacing for the blade 38 is desired, reference is hereby made to the teachings of Frank Brautigam in U.S. Pat. No. 3,764,062, and also to the disclosure of Leonard Shapiro in U.S. Pat. No. 4,328,925. All of the patents cited immediately above are assigned to the assignee of the present invention.

Centrifugal separators of the type described are used to separate solids and liquids from a mixture thereof in a slurry. The slurry or feed is fed from outside the separator 10 to the interior thereof via an axially extending feed pipe 42 to a feed chamber 44 within the bowl hub 36. Feed entering the chamber 44 strikes a target plate 46, and it is redirected outwardly through feed nozzles 48 in the hub 36. The feed next enters a separation chamber 50 defined by the exterior of the hub 36 and the interior of the bowl 16. By centrifugal action in the chamber 50 the feed is separated into an inner layer of liquid phase material and an outer layer of solids phase material. As noted previously herein, the liquid phase material or effluent is discharged from the bowl 16 via liquid discharge means, i.e. the dam 20 at end 18 of the bowl. Also as noted previously, the screw conveyor 17 conveys the solids phase material toward the end 22 of the bowl for discharge by the solids discharge means, i.e. the discharge nozzles 24.

As is well known in the centrifuge art, the conveying action of the screw conveyor 17 results from its rotation by a drive 25 in the same direction as the bowl 16 but at a slightly different speed.

Attention is directed to the absence from the present apparatus of a wier or overflow lip at the end of a tapered bowl, a device frequently used as solids discharge means in previous centrifugal separators of the type set forth herein. Instead, according to the present invention, all of the separated solids may be discharged through the discharge nozzles 24; and to accomplish this at low risk of pluggage a generous cross-sectional flow area of the discharge nozzles 24 is provided in combination with the controlled recycle system 12 for recycling discharged solids to the inlets of the discharge nozzles 24.

The flow area of the discharge nozzles 24 may be determined with knowledge of the feed flow rate, the concentration of solids in the feed, and the separation efficiency of the apparatus under various conditions. In practicing the present invention, a typical nozzle diameter of 0.306 inches (7.7 mm.) for each of four nozzles 24 will be employed to handle a feed variation of 0.5% to 2.0% feed solids for 600 gallons per minute and a recycle rate of between 0 to 125 gallons per minute to maintain a constant underflow concentration of 6%.

The recycle system 12 shown in FIG. 1 comprises a recycle conduit 56 which is connected to a lower portion of the tank 35 and has a pump 58 installed therein for pumping discharged solids therethrough to and beyond junction 60. A disposal conduit 62 is connected to recycle conduit 56 at junction 60 and it serves to conduct discharged solids, identified as "product" in FIG. 1, therethrough to a desired location when a valve 64 in the disposal conduit 62 is open. The recycle conduit 56 extends beyond junction 60 to conduct discharged solids back to the separator 10 when a valve 68 in the recycle conduit is open. The extension of the recycle conduit 56 through the feed pipe 42 will be described hereinafter.

To some extent the recycle system 12 is self-regulating because as the viscosity of the recycled solids increases so does its resistance to flow through conduit 56 and recycle passageway 72, thereby reducing the amount of solids fed back to nozzles 24.

A flow control device 69, responsive to the pressure of the recycled solids flowing through conduit 56, is preferably installed in conduit 56 for the purpose of adjusting valve 68. The valve 68 is wholly or partly closed to reduce the recycle flow rate when a predetermined pressure is high, corresponding to high solids concentration levels in conduit 56, and conversely the control device 69 keeps valve 68 open to increase the recycle flow rate when low solids concentration levels are detected and the nozzles 24 are discharging excessively wet or less viscous solids.

Figure 2:
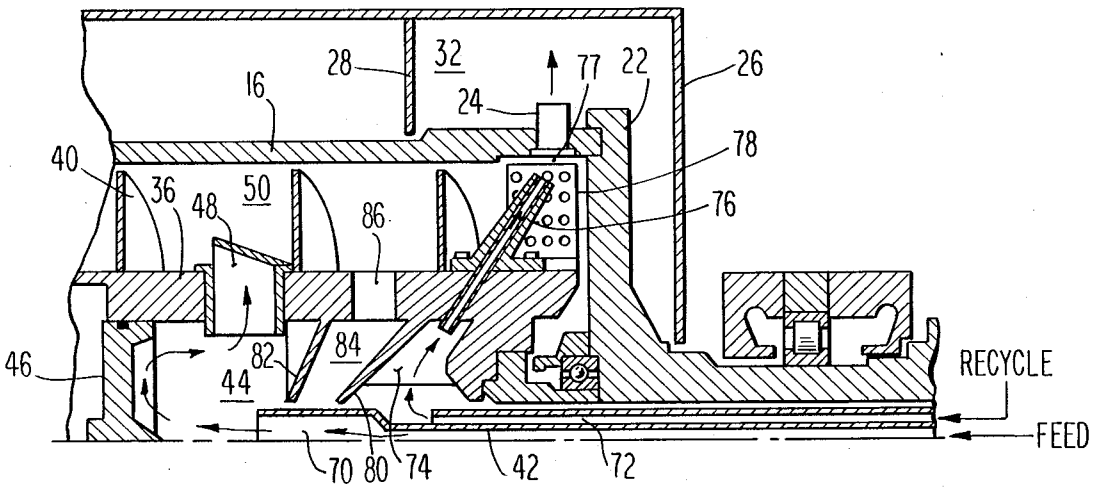
FIG. 2 is an enlarged longitudinal sectional view of a fragment of the centrifuge of FIG. 1.
Figure 5:
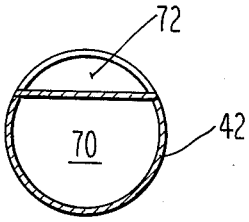
FIG. 5 is a transverse sectional view of the feed pipe, taken along line 5—5 of FIG. 4.
Figure 4:
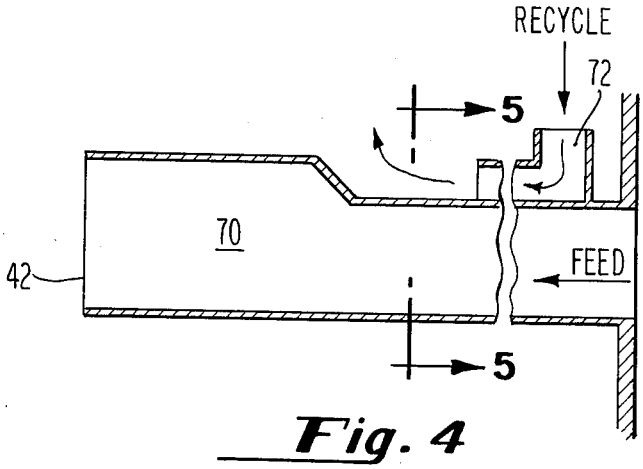
FIG. 4 is an enlarged, longitudinal sectional view of the feed pipe of FIG. 2.

As shown in detail in FIGS. 2, 4 and 5, the feed pipe 42 includes a main passage 70 extending along the rotational axis of the bowl 16 for conducting feed to the feed chamber 44. The feed pipe 42 also includes an extension of the recycle conduit 56 in the form of a secondary passage or recycle passage 72 for conducting them to a recycle chamber 74 within an end portion of the hub 36. The recycle chamber 74 is of annular configuration disposed about the feed pipe 42. An annular array of recycle tubes 76, preferably six of them, are secured to the hub 36 adjacent the one end of bowl 16. The recycle tubes 76 conduct recycled solids from the recycle chamber 74, where their inlets are disposed, to that portion or zone 77 of the separation chamber 50 immediately adjacent to the inlets of the discharge nozzles 24. The outlets of the nozzles 24 are exterior of the bowl 16.

In order to sweep accumulations of solids away from locations adjacent the inlets of the discharge nozzles 24, a pair of wiper plates 78 are secured to opposite sides of the hub 36. The wiper plates 78 are preferably of perforated construction in order to minimize turbulence, and they are positioned in a radial and axial plane, as best seen in FIGS. 2 and 3. The sweeping action of the wiper plates 78 prevents a buildup of solids under centrifugal force which could otherwise obstruct the inlets of the discharge nozzles 24.

Internal Partition Feature

Optionally, as shown in FIG. 2, the feed chamber 44 and the recycle chamber 74 are separated by partitions 80 and 82 defining an overflow chamber 84, thereby preventing intermixing of fresh feed from main passage 70 with recycled solids from main passage 72, or vice versa. In the event of overflow from either or both chambers 44 and 74 into the overflow chamber 84, the overflowing material passes through the overflow hole 86 in hub 36 into the separation chamber 50 where it is separated in a conventional manner.

Modifications

The invention may be practiced with variations which will occur to those skilled in art, including a substitution of an equivalent for the recycle tubes 76, such as a passageway defined by other structure in which the recycled solids avoid contact and mixing with the newly introduced feed.

What is claimed is:

1. Centrifuge apparatus for the continuous separation of a mixture of solids and liquid into separate light phase and heavy phase components, with means for concentrating said heavy phase component, comprising: an elongated tubular bowl, having an interior at least partly defining a separation chamber for receiving said mixture for separation therein, said bowl at one end thereof defining a zone for the collection of said heavy phase component after centrifugal separation in the bowl and having a solids discharge means for discharging said heavy phase component from said zone, said bowl being further provided with means operatively independent of said zone for discharging said light phase component from the bowl, said bowl being mounted for rotation about its longitudinal axis, a screw conveyor helically and coaxially mounted within said bowl for conveying the heavy phase component separated in the separation chamber toward said zone, said screw conveyor including a hub defining therein a feed chamber having an outlet to said separation chamber, a feed pipe for conducting said mixture to said feed chamber, means for rotating said bowl and said screw conveyor at a speed differential, and wherein said solids discharge means is a plurality of first nozzles mounted on said bowl, with each first nozzle having an inlet in said zone and an outlet exteriorly of said bowl, and means including a conduit and a plurality of tubes for recycling through said hub to said zone at least a portion of the heavy phase component collected in said zone and discharged from said nozzles, said tubes being mounted on said hub with their outlets extending into said zone and their inlets communicating through the interior of said hub with said conduit.

2. Centrifuge apparatus according to claim 1 wherein the means for discharging said light phase component is located at the other end of said bowl opposite said one end of said bowl.

3. Centrifuge apparatus according to claim 2 wherein the light phase discharge means is a discharge port in said other end of said bowl.

4. Centrifuge apparatus according to claim 1 wherein the outlet of said conduit is a recycle chamber defined by the interior of said hub.

5. Centrifuge apparatus according to claim 4 further including wall structure within said hub defining therewith said feed chamber, said recycle chamber, and an overflow chamber between said feed chamber and said recycle chamber in communication therewith and also with said separation chamber, positioned to receive overflowing feed mixture and recycled heavy phase component and to pass the same to said separation chamber.

6. Centrifuge apparatus according to claim 1 wherein the flow area of each of said first nozzles is greater than 3 millimeters.

7. Centrifuge apparatus according to claim 1 further including a pump promoting the flow of recycled solids through said conduit, and valve means in said conduit for diverting the flow of recycled solids from said conduit when actuated, and flow control means responsive to the viscosity of said recycled solids for actuating said valve means at a predetermined viscosity.

8. Centrifuge apparatus according to claim 7 wherein said flow control means is responsive to pressure within said conduit for actuating said valve means at a predetermined pressure, whereby an increase in the pressure of said recycled solids corresponding to an increase in viscosity of said recycled solids causes the activation of said valve means and thereby reduces the amount of discharged solids recycled to said zone.

9. Centrifuge apparatus according to claim 8 wherein said first nozzles are disposed in an annular array about said longitudinal axis of the bowl.

10. Centrifuge apparatus according to claim 1 wherein said tubes are disposed in an annular array and connected in parallel to said conduit.

11. In a centrifuge with a tubular bowl and a helical conveyor mounted for rotation therein for continuously separating mixtures of solids and liquid, having liquid discharge means for discharging separated liquid at one end of the bowl, wherein the mixture of solids and liquid is fed into the conveyor through a feed chamber having a feed pipe, and the improvement wherein at least some of the centrifuged solids are conveyed after separation to a collection zone at the other end of the bowl and there extracted through discharge nozzles located below the surface of the liquid in the bowl, means forming a recycle chamber in the vicinity of the discharge nozzles and having a recycle passageway and recycle tubes in communication therewith but operatively independent of said liquid discharge means.

* * * * *